US011542747B2

(12) United States Patent
Neander et al.

(10) Patent No.: US 11,542,747 B2
(45) Date of Patent: Jan. 3, 2023

(54) COVERING ELEMENT FOR BUS BAR

(71) Applicant: SAINT-GOBAIN GLASS FRANCE, Courbevoie (FR)

(72) Inventors: Marcus Neander, Eschweiler (DE); Christopher Marjan, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 16/973,266

(22) PCT Filed: Jun. 25, 2019

(86) PCT No.: PCT/EP2019/066724
§ 371 (c)(1),
(2) Date: Dec. 8, 2020

(87) PCT Pub. No.: WO2020/007638
PCT Pub. Date: Jan. 9, 2020

(65) Prior Publication Data

US 2021/0246714 A1 Aug. 12, 2021

(30) Foreign Application Priority Data

Jul. 4, 2018 (EP) ..... 18181596

(51) Int. Cl.
*E06B 3/663* (2006.01)
*E06B 3/67* (2006.01)
(Continued)

(52) U.S. Cl.
CPC ..... *E06B 3/66366* (2013.01); *E06B 3/66319* (2013.01); *E06B 3/6722* (2013.01);
(Continued)

(58) Field of Classification Search
CPC ..... E06B 3/66; E06B 3/663; E06B 3/66366; E06B 3/66319; E06B 3/6722; E06B 2003/6638; E06B 3/66304
See application file for complete search history.

(56) References Cited

U.S. PATENT DOCUMENTS 5,439,716 A * 8/1995 Larsen ..... E06B 3/66314 52/786.13
5,460,862 A * 10/1995 Roller ..... E06B 3/66319 428/35.8
(Continued)

FOREIGN PATENT DOCUMENTS

CN 102388197 A 3/2012
CN 206769706 U 12/2017
(Continued)

OTHER PUBLICATIONS

Translation to English for EP 3 093 423 A1 via espacenet. accessed Apr. 7, 2022. (Year: 2015).*
(Continued)

*Primary Examiner* — Nancy R Johnson
(74) *Attorney, Agent, or Firm* — Pillsbury Winthrop Shaw Pittman LLP

(57) ABSTRACT

A spacer for an insulating glazing, includes a main body, which is a main body A including a first pane contact surface, a second pane contact surface, a glazing interior surface, and an outer surface, or which is a main body B including a first pane contact surface, a second pane contact surface, a first glazing interior surface, a second glazing interior surface, a first inner lateral surface, a second inner lateral surface, and an outer surface, wherein the two inner lateral surfaces, together with the two glazing interior surfaces and the outer surface, form a groove for receiving a pane. The spacer has a screen panel made of an opaque material arranged on the glazing interior surface of the main
(Continued)

Figure 1:
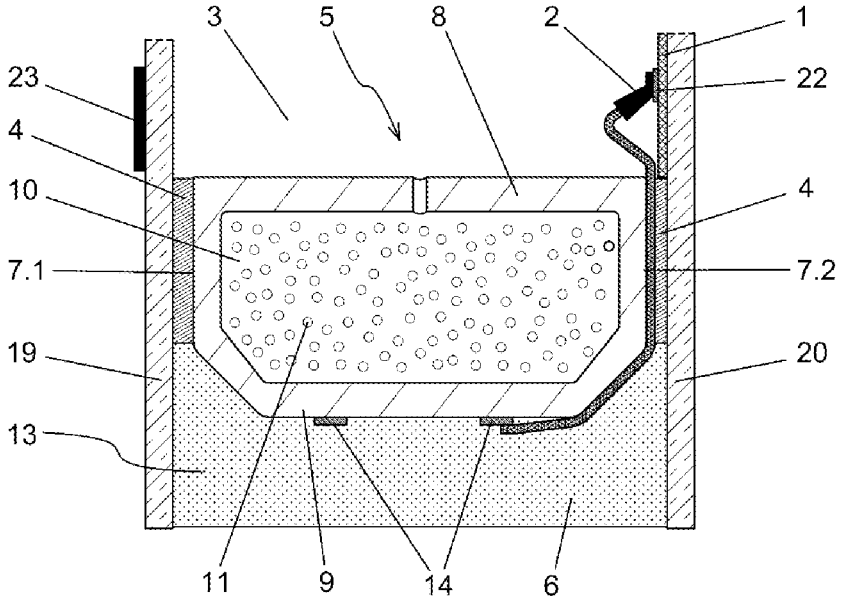

body A or a screen panel arranged on one of the two glazing interior surfaces of the main body B and extending parallel to the two pane contact surfaces.

16 Claims, 11 Drawing Sheets

(51) Int. Cl.
*E06B 9/24* (2006.01)
*E06B 9/264* (2006.01)

(52) U.S. Cl.
CPC ..... *E06B 9/24* (2013.01); *E06B 2003/6638* (2013.01); *E06B 2009/2643* (2013.01)

(56) References Cited

U.S. PATENT DOCUMENTS

| | | | | |
|---|---|---|---|---|
| 6,108,999 | A | 8/2000 | Smith et al. | |
| 2014/0247475 | A1 | 9/2014 | Parker et al. | |
| 2014/0311065 | A1* | 10/2014 | Schreiber | E06B 3/66319 52/204.593 |
| 2016/0138326 | A1* | 5/2016 | Kuster | E06B 3/67 52/204.595 |
| 2016/0344148 | A1 | 11/2016 | Mullins et al. | |
| 2018/0364539 | A1* | 12/2018 | Rozbicki | E06B 9/24 |

FOREIGN PATENT DOCUMENTS

| | | | |
|---|---|---|---|
| DE | 34 32 113 | A1 | 3/1986 |
| DE | 10 2015 004913 | A1 | 10/2016 |
| EP | 2 626 496 | A1 | 8/2013 |
| EP | 2 628 884 | A2 | 8/2013 |
| EP | 3093423 | A1 * | 11/2016 |
| JP | H11-336451 | A | 12/1999 |
| JP | 2012-020919 | A | 2/2012 |
| SE | 513 554 | C2 | 10/2000 |
| WO | WO 2005/122888 | A1 | 12/2005 |
| WO | WO 2006/075922 | A1 | 7/2006 |
| WO | WO 2018/020191 | A1 | 2/2018 |
| WO | WO 2019/141532 | A1 | 7/2019 |
| WO | WO 2019/141533 | A1 | 7/2019 |
| WO | WO 2019/141700 | A1 | 7/2019 |
| WO | WO 2019/141749 | A1 | 7/2019 |

OTHER PUBLICATIONS

Office Action as issued in Indian Patent Application No. 202017047413, dated Apr. 28, 2021.
International Search Report as issued in International Patent Application No. PCT/EP2019/066724, dated Jul. 26, 2019.
Notice of Reasons for Refusal as issued in Japanese Patent Application No. 2020-568667, dated Dec. 14, 2021.
Office Communication as issued in European Patent Application No. 19733026.9, dated Oct. 19, 2021.
First Office Action as issued in Chinese Patent Application No. 201980044337.3, dated Apr. 6, 2022.

* cited by examiner

COVERING ELEMENT FOR BUS BAR

CROSS-REFERENCE TO RELATED APPLICATIONS

This application is the U.S. National Stage of PCT/EP2019/066724, filed Jun. 25, 2019, which in turn claims priority to European patent application number 18181596.0 filed Jul. 4, 2018. The content of these applications are incorporated herein by reference in their entireties.

The invention relates to a spacer, an insulating glazing containing this spacer, and the use of spacers and insulating glazing.

Insulating glazings are widely used as glazing in buildings. Insulating glazings are increasingly frequently installed in glass façades for aesthetic reasons, in particular when the façade is optically implemented as an all glass façade.

An insulating glazing is made of at least two panes that are held at a distance from one another by a spacer. The panes can have a coating, such as a thermal protection coating and/or a solar protection coating. In particular, silver-containing coatings enable low transmittance of infrared radiation and thus reduce the temperature in the building interior. The thermal insulation of insulating glazing is significantly better than that of single pane glass and can be further improved in the case of triple glazing.

In addition to the important property of thermal insulation, functional as well as optical and aesthetic features play an increasingly important role in the area of architectural glazing. For this, functional coatings or functional elements are generally required. Such functional coatings or functional elements usually require contact with a supply voltage, for which further components, such as connection elements and bus bars, must be provided. In principle, each additional component increases the complexity of an insulating glazing and can worsen the insulating effect.

Additionally, the optical transparency and the overall visual impression of the insulating glazing are often adversely affected. For example, an insulating glazing with an electrochromic coating requires electrical connections and bus bars. One problem associated, for example, with bus bars consists in that the bus bars are visible from the outside, which reduces the visible region of the window and, moreover, is aesthetically unsightly.

The prior art usually resorts to an opaque coating, usually screen printed onto a pane, or to an opaque component mounted on a pane to conceal the bus bars. Such a solution is, however, associated with some disadvantages.

On the one hand, an additional production step is required for applying the opaque coating or components, thus increasing production costs and processing time. On the other hand, the aesthetic benefit is limited since relatively large areas of the pane must be provided with the opaque coating or components in order to achieve suitable concealing of the bus bars, excessively limiting the visible area of the insulating glass. Moreover, for production engineering reasons, the opaque coating or components and the spacer used usually have different colors, which is likewise undesirable for aesthetic reasons.

Moreover, the opaque coating or components also adversely affect the thermal properties of the insulating glazing, because they usually have different thermal characteristics from the panes, e.g., in terms of thermal expansion, which can result in mechanical stress or even in thermal breakage when the temperature changes.

EP 2626496 A1 relates to a spacer that comprises outer side walls, wherein each side wall has an inner protrusion. The document also describes an insulating pane, comprising at least two glazing panes that are distanced from each other by the spacer profile, wherein the inner protrusions of the spacer profile are situated in the interspace formed and serve to hold an interspace element situated in the interspace.

EP 2628884 A2 describes a kit for insulating glasses, comprising a plurality of spacer elements, wherein each spacer element is made of plastic and includes at least one metallic insert, wherein, in one embodiment, the spacer elements have a protrusion on a lateral surface of the spacer element, which protrudes into the interior of the insulating glass.

WO 2006/075922 A1 relates to an insulation glass including an inner blind and a spacer, wherein the spacer has a protruding part in the interspace of the insulation glass, which is shaped as a rail or wing and is provided with a sliding element.

DE 3432113 A1 relates to a laminated window formed by spacers and panes with reflector profiles arranged in the interpane air space which serve to control the passage of light through the laminated window, wherein the reflector profiles can be suspended on the front side in the spacers and these spacers have extensions.

U.S. Pat. No. 6,108,999 A describes a window glazing unit, comprising a first glass pane, an impact-resistant thermoplastic pane, and a second glass pane. One figure depicts a spacer that spaces the first and second glass pane apart and has, in the center, a depression in which the thermoplastische pane is placed. The spacer has protrusions on both sides of the depressions.

US 2014/247475 A1 relates to an insulated glass unit, comprising a first glass substrate, a second glass substrate, an electrochromic device that is positioned on the first or second glass substrate, two bus bars that are electrically connected to the electrochromic device, and a spacer. The spacer can have recesses or notches at the upper and lower inner corners of the spacer.

The object of the present invention was, consequently, to overcome the above mentioned problems in the prior art. In particular, the object of the invention was to improve the aesthetic appearance and to extend the through-vision area of an insulating glazing, in which elements to be concealed, such as bus bars, are present, such as in an insulating glazing with an electrochromic coating. The object further consisted in producing such an insulating glazing more economically and in improving its thermal stability.

The inventors have now found that this object can be accomplished by attaching a screen panel directly on the spacer of the insulating glazing in order to conceal the region where the component to be concealed, such as a bus bar, is situated in the insulating glazing.

The object of the present invention is, consequently, accomplished according to the invention by a spacer as defined below and an insulating glazing as defined below. Preferred embodiments emerge from the various embodiments described below.

Accordingly, the present invention relates to a spacer for an insulating glazing, wherein the spacer comprises a main body, which is a main body A comprising a first pane contact surface, a second pane contact surface extending parallel thereto, a glazing interior surface, and an outer surface, or which is a main body B comprising a first pane contact surface and a second pane contact surface extending parallel thereto, a first glazing interior surface, a second glazing interior surface, a first inner lateral surface, a second inner lateral surface, and an outer surface, wherein the two inner lateral surfaces extend between the two pane contact surfaces and parallel thereto and, together with the two glazing interior surfaces and the outer surface, form a groove for receiving a pane, wherein the spacer has at least one screen panel made of opaque material arranged on the glazing interior surface of the main body A or at least one screen panel arranged on at least one of the two glazing interior surfaces of the main body B and extending parallel to the two pane contact surfaces.

By using the spacer according to the invention in an insulating glazing that has components to be concealed, such as bus bars, a significant improvement in the aesthetic appearance of the insulating glazing can be achieved. Compared to an opaque coating mentioned above, the covering region can, for example, be designed smaller with the same effect, since the screen window is situated nearer the component to be concealed. This also increases the through-vision area of the insulating glazing. Furthermore, the screen panel and the spacer can easily have the same color, which is inevitably the case in some embodiments, as a result of which the appearance is more uniform.

Another advantage consists in that no additional process steps, such as the application of a screen print, are required for the covering, as a result of which production costs are reduced and processing times are shortened.

In addition, this leads to improved thermal properties of the insulating glazing, since the use of opaque coatings for the covering, which have different thermal properties compared to the panes used, can be avoided. For example, in the case of conventional insulating glazings, breakage damage can occur with temperature changes if the region of the screen print selected for the covering is too large. The spacers according to the invention make larger covering regions possible.

The invention is explained in detail in the following.

In the present description, the following relative spatial designations apply to the spacer and accordingly to the insulating glazing containing the spacer, unless otherwise indicated. The outer surface of the spacer is situated "below" and the glazing interior surface is situated "above". Accordingly, the pane contact surfaces are situated "laterally". The direction from a lateral contact surface to a perpendicular line in the center of the outer surface of the spacer is from "outside" to "inside". Accordingly, the two lateral contact surfaces are situated on the outside.

The "width" of a main body refers to the direction from the first lateral contact surface to the second lateral contact surface. The "height" of a main body refers to the direction from the outer surface to the glazing interior surface or surfaces. The "longitudinal direction" is accordingly perpendicular to the width and height along the lateral contact surface. "Cross-section" refers to the cross-section at right angles to the two pane contact surfaces, unless otherwise indicated.

An insulating glazing comprises at least two panes that are kept at a distance from one another by a spacer. Another term for "insulating glazing" is "multi-pane insulating glass". There is, for example, double-pane insulating glass, which comprises two panes, and triple-pane insulating glass, which comprises three panes, and quadruple-pane insulating glass, which comprises four panes.

The spacer according to the invention for an insulating glazing comprises a main body and at least one screen panel.

Spacers that distance two panes from one another are common. These can generally be used for multi-pane insulating glasses, such as double-pane insulating glasses, triple-pane insulating glasses, and quadruple-pane insulating glasses. Accordingly, for triple-pane and quadruple-pane insulating glasses, two or three such spacers are required: a first spacer to distance an outer pane from the inner pane and a second spacer to distance the other outer pane from the inner pane. Spacers that can distance three panes from another are also used.

A main body of a spacer that can keep two panes at a distance from one another is referred to here as a "main body A". A main body of a spacer that can keep three panes at a distance from one another is referred to here as a "main body B". Unless otherwise indicated, the expression "main body" generally refers here both to the main body A and to the main body B.

The spacer according to the invention comprises a main body that is a main body A as described below or a main body that is a main body B as described below.

The main body A has a first pane contact surface, a second pane contact surface extending parallel to the first pane contact surface, a glazing interior surface, and an outer surface. The outer surface, often also referred to as a bonding surface, can be connected directly to the first and second pane contact surface. In a preferred embodiment, the outer surface is connected to the first and/or the second pane contact surface via connecting surfaces, i.e., to the first pane contact surface via a first connecting surface and/or to the second pane contact surface via a second connecting surface, wherein, preferably, both pane contact surfaces are connected to the outer surface via such connecting surfaces. The connecting surface can, for example, be at an angle in the range from 30° to 60° relative to the outer surface. The two pane contact surfaces are usually approx. perpendicular or perpendicular to the plane in which the outer surface is situated.

The glazing interior surface of the main body A can usually be connected directly to the first and second pane contact surface. This direct connection is usually preferred; however, the glazing interior surface can also be connected to the first and/or the second pane contact surface via connecting surfaces. In this way, each pane contact surface is connected directly or indirectly to the outer surface on one side and connected directly or indirectly to the glazing interior surface on the opposite side. The two pane contact surfaces are usually approx. perpendicular or perpendicular to the plane in which the glazing interior surface is situated. It is usually preferable for the outer surface and the glazing interior surface to be parallel to one another.

The main body A can, optionally, have one or a plurality of hollow spaces in the interior. The glazing interior surface preferably has openings to facilitate the absorption of atmospheric moisture by desiccant optionally present in the main body.

It goes without saying that the dimensions of the main body depend on the dimensions of the insulating glazing in which it is to be used. The width of the main body A can, for example, be in the range from 4 to 30 mm, preferably 8 to 16 mm. The height of the main body A can, for example, be in the range from 5 to 15 mm, preferably 5 to 10 mm.

The main body B that is suitable for spacing three panes has a first pane contact surface and a second pane contact surface extending parallel to the first pane contact surface, a second glazing interior surface, a first inner lateral surface, a second inner lateral surface, and an outer surface. The two inner lateral surfaces extend between the two pane contact surfaces and parallel thereto and form, together with the two glazing interior surfaces and the outer surface, a groove for receiving a pane. The groove is suitable for receiving an inner or third pane. As already mentioned, two individual spacers can also be used for triple-pane insulating glasses for the spacing of two panes in each case.

The outer surface of the main body B can be connected directly to the first and second pane contact surface. In a preferred embodiment, the outer surface is connected to the first and/or the second pane contact surface via connecting surfaces, i.e., to the first pane contact surface via a first connecting surface and/or to the second pane contact surface via a second connecting surface, wherein, preferably, both pane contact surfaces are connected to the outer surface via such connecting surfaces. The connecting surface can, for example, be at an angle in the range from 30° to 60° relative to the outer surface. The two pane contact surfaces are usually approx. perpendicular or perpendicular to the plane in which the outer surface is situated.

The first glazing interior surface of the main body B can usually be connected directly to the first pane contact surface and the first inner lateral surface. The direct connection is usually preferred; however, the first glazing interior surface can also be connected to the first pane contact surface and/or the first inner lateral surface via connecting surfaces. The side of the first inner lateral surface that is opposite the side that is connected to the first glazing interior surface is usually connected thereto in an inner region of the outer surface. The second glazing interior surface of the main body B can usually be connected directly to the second pane contact surface and the second inner lateral surface. This direct connection is usually preferred; however, the second glazing interior surface can also be connected to the second pane contact surface and/or the second inner lateral surface via connecting surfaces. The side of the second inner lateral surface that is opposite the side that is connected to the second glazing interior surface is usually connected thereto in an inner region of the outer surface.

The two pane contact surfaces are usually approx. perpendicular or perpendicular to the plane in which the first and second glazing interior surface are situated. It is usually preferable for the outer surface and the two glazing interior surfaces to be parallel to one another.

The main body B can, optionally, have one or a plurality of hollow spaces in the interior, e.g., a hollow space between the first pane contact surface and the first inner lateral surface and a hollow space between the second pane contact surface and the second inner lateral surface. The two glazing interior surfaces preferably have openings to facilitate the absorption of atmospheric moisture by desiccant optionally present in the main body.

It goes without saying that the dimensions of the main body depend on the dimensions of the insulating glazing in which it is to be incorporated. The width of the main body B can, for example, be in the range from 10 to 50 mm, preferably 20 to 36 mm. The height of the main body B can, for example, be in the range from 5 to 15 mm, preferably 5 to 10 mm.

The spacer according to the invention is characterized in that it has at least one screen panel made of an opaque material. In the case of the spacer with the main body A, the at least one screen panel is situated on the glazing interior surface of the main body. In the case of the spacer with the main body B, the at least one screen panel is situated on at least one of the two glazing interior surfaces of the main body B. Both in the case of the main body A and in the case of the main body B, the at least one screen panel runs parallel to the first pane contact surface and parallel to the first [sic] pane contact surface.

The screen panel is made of an opaque material such that an object behind the panel cannot be seen.

The height of the screen panel can vary as needed and depends, among other things, on the position and dimensions of the element to be concealed in the insulating glazing, the position of the screen panel relative to the element to be concealed, and the desired degree of screening with regard to the viewing angles to be taken into account.

The "height h" of the screen panel refers to the distance between the glazing interior surface on which the screen panel is situated and the upper end of the screen panel. In general, it has proved expedient for the height h of the screen panel to be equal to or higher than the height of the element to be concealed, e.g., a bus bar. The "height" of the element to be concealed means the distance between the plane of the glazing interior surface on which the screen panel is situated and the upper end of the element to be concealed.

The screen panel can, for example, have a height h in the range from 2 to 50 mm, preferably from 4 to 40 mm, particularly preferably 4 to 15 mm. The height h is as defined above, see also FIG. 4.

The spacer comprising a main body that is the main body A preferably has 1 or 2 screen panels, more preferably 1 screen panel. The spacer comprising a main body that is the main body B preferably has 1, 2, 3, or 4 screen panels, more preferably 1 or 2 screen panels.

The screen panel is usually situated along the entire length of the main body. However, it is optionally conceivable for the screen panel to be situated only over part of the length of the main body.

The screen panel is preferably arranged in the edge region of the glazing interior surface. The edge region can be the region in the vicinity of the first or second lateral contact surface (in the case of main body A or main body B) or of the first or second inner lateral surface (in the case of main body B).

In a preferred embodiment for the spacer with the main body A, a screen panel is arranged on the edge region of the glazing interior surface toward the first pane contact surface and/or a screen panel is arranged on the edge region of the glazing interior surface toward the second pane contact surface.

In a preferred embodiment for the spacer with the main body B, a screen panel is arranged on the edge region of the first glazing interior surface toward the first pane contact surface and/or a screen panel is arranged on the edge region of the second glazing interior surface toward the second pane contact surface, and/or a screen panel is arranged on the edge region of the first glazing interior surface toward the first inner lateral surface, and/or a screen panel is arranged on the edge region of the second glazing interior surface toward the second inner lateral surface.

For the spacer with the main body B, it is particularly preferred for a screen panel to be arranged on the edge region of the first glazing interior surface toward the first inner lateral surface and/or a screen panel to be arranged on the edge region of the second glazing interior surface toward the second inner lateral surface. Alternatively, or additionally, it is further preferred for the spacer with the main body B to have a screen panel on the edge region of the first glazing interior surface toward the first pane contact surface and a screen panel on the edge region of the second glazing interior surface toward the second pane contact surface.

It is particularly preferred for one side of the screen panel to be arranged directly at the edge of the glazing interior surface, i.e., at the edge toward the first or second lateral contact surface (in the case of main body A or main body B)

or at the edge toward the first or second inner lateral surface (in the case of main body B). The side of the screen panel can thus be flush with the respective lateral surface, i.e., with the first lateral contact surface, the second lateral contact surface, the first inner lateral surface, or the second inner lateral surface. The above-mentioned preferred embodiments for positioning the screen panel or the screen panels on the respective edge regions apply mutatis mutandis to the embodiments in which one side of the screen panel is arranged directly on the edge of the glazing interior surface, as described above.

The screen panel can have, in cross-section, any desired geometry that can be selected based on expediency. The screen panel can have, for example, in cross-section, a rectangular basic shape; or the screen panel can at least partially taper, in cross-section, from bottom to top, for example, in a trapezoidal or triangular shape.

The rectangular basic shape includes, for example, a rectangular shape or a rectangular shape in which the edges are rounded at the upper end of the screen panel. A screen panel that tapers, in cross-section, at least partially from bottom to top, preferably conically, can be advantageous for production engineering reasons and/or stability reasons. In this embodiment, it is particularly advantageous for one side of the screen panel to be flush with the respective lateral surface, i.e., with the first lateral contact surface, the second lateral contact surface, the first inner lateral surface, or the second inner lateral surface and the opposite side of the screen panel to taper at least partially from bottom to top, in particular to taper conically. In an alternative embodiment, the screen panel, which tapers, in cross-section, at least partially from bottom to top, can be trapezoidal or rectangular.

The width of the screen panel can vary considerably. If the screen panel tapers, there is no uniform width. In general, the maximum width of the screen panel, usually the width at the lower end of the screen panel, is less than 40%, preferably less than 30%, of the width of the glazing interior surface on which the screen area is arranged. If the screen panel has a substantially uniform width, i.e., does not taper, for example, in the rectangular basic shape, the width b can be, for example, in the range from 0.2 to 5 mm, preferably from 0.5 to 3 mm.

In preferred embodiments, at least one screen panel is flush with the first or the second pane contact surface on the outwardly directed side, and/or at least one screen panel is flush with the first or the second inner lateral surface on the inwardly directed side.

The main body (main body A or main body B) of the spacer according to the invention can be formed in one piece with the at least one screen panel, or the main body (main body A or main body B) and the at least one screen panel form separate parts that are connected to one another.

If the main body and the at least one screen panel are separate parts, they can be connected to one another in any manner known to the person skilled in the art, e.g., by gluing or a plug or clip system. The gluing can, for example, be done by means of an adhesive layer or double-sided adhesive tapes. Suitable plug and clip systems can also be used. In the case of a plug or clip system, the main body and the screen panel can be provided, for example, with corresponding connecting means that enable plugging together. When the main body and the screen panel are made of metal, a connection can also be made by soldering.

In a particularly preferred embodiment, the main body is formed in one piece with the at least one screen panel, i.e., the main body and the at least one screen panel are made of one piece or monolithic. This is particularly advantageous when the main body and the at least one screen panel are made of an extrudable material, such as plastic. In this case, the main body, together with the screen panel(s), can be produced in one step by extrusion.

The main body (main body A or main body B) and the at least one screen panel can be made of a different material or of the same material. Preferably, the main body and the at least one screen panel are made of the same material. If the main body is formed in one piece with the at least one screen panel, this is the usual result.

The main body and the at least one screen panel are, independently of one another, preferably made of metal or plastic. Examples of suitable materials are steel and aluminum. Plastic is preferred, whereby materials with lower thermal conductivity, so-called "warm edge" systems can advantageously be used. Plastic main bodies are also referred to as "polymeric main bodies".

The usual polymers can be used for the plastic main body and the screen panel. The main body and the screen panel contain, e.g., independently of one another, polyethylene (PE), polycarbonates (PC), polypropylene (PP), polystyrene, polybutadiene, polynitriles, polyesters, polyurethanes, polymethyl methacrylates, polyacrylates, polyamides, polyethylene terephthalate (PET), silicones, polybutylene terephthalate (PBT), preferably acrylonitrile butadiene styrene (ABS), acrylonitrile styrene acrylester (ASA), acrylonitrile butadiene styrene-polycarbonate (ABS/PC), styrene acrylonitrile (SAN), PET/PC, PBT/PC, and/or copolymers or mixtures thereof. The main body and the screen panel are preferably made of the same material. However, they can also be made of different materials, in particular different polymeric materials. This could be advantageous, for example, for reasons of cost.

The plastics used for the main body and/or the screen panel are preferably thermoplastic materials. The main body and the screen panel made of such a material can be produced as a prefabricated profile, either as separate parts that are subsequently joined to one another or in one piece, and the spacer obtained is then fixed between the panes to produce the insulating glazing. In this case, the pane contact surfaces of the spacer are connected to the panes via a sealant.

Alternatively, the main body and the at least screen panel [sic] can be extruded directly onto the pane, in this case as one piece. Usually, no separate sealant is then required for the connection to the pane; the main body is connected directly to the pane. Used for this, are, for example, injectable thermoplastic spacers (TPS spacers) made of sealant materials such as polyisobutylene and butyl rubber, which can contain desiccant in the matrix. These sealant materials can also be used for producing the main body and the at least screen panel [sic] in one piece.

The main body and the screen panel, in particular those made of plastic, can, optionally contain, independently of one another, one or a plurality of additives that are customary for such materials, e.g., desiccants, colorants, e.g., pigments or dyes, reinforcing materials, fillers, light stabilizers, stabilizers, release agents, and the like. Desiccants can be contained in hollow spaces or recesses of the main body or in the plastic matrix of the main body or of the screen panel. Other additives are usually contained in the plastic matrix of the main body and/or of the screen panel.

Examples of suitable desiccants are silica gels, molecular sieves, $CaCl_2$), $Na_2SO_4$, activated carbon, silicates, bentonites, zeolites, and/or mixtures thereof.

In a preferred embodiment, the main body is not transparent, i.e., opaque, like the screen panel. The main body and the at least one screen panel can be a different color or preferably the same color. Usual colors for the main body and/or the screen panel are, e.g., black, white, brown, or gray, in particular if the main body or screen panel is made of plastic. For coloring, appropriate colorants, such as pigments or dyes can be contained in the main body and/or the screen panel. Alternatively, or additionally, the main body and/or the screen panel can be provided with a colored coating. In the case of a main body and/or a screen panel made of metal, the color usually results from the material used. It goes without saying that in the case of one-piece spacers, the main body and the screen panel are usually made from the same material and, consequently, have the same color.

The spacer according to the invention is, in particular, suited for use in an insulating glazing. Therefore, the invention also relates to an insulating glazing that comprises at least two panes and at least one spacer according to the invention as described above. Preferably, it is an insulating glazing consisting of two, three, or four panes, preferably of two or three panes. The insulating glazing generally also has at least one element to be concealed which is to be concealed by the at least one screen panel. The element to be concealed can, for example, be a bus bar and/or a connection line, such as an electrical connection element and/or an electrical contact element, preferably a bus bar.

The at least two panes form, together with the spacer, at least one glazing interior, in which, preferably, an element to be concealed, in particular a bus bar, is arranged on a pane, wherein the screen panel of the spacer obscures the element to be concealed when viewed from the outside, at least from certain viewing angles.

The element to be concealed, in particular the bus bar, is attached on an inner side of one of the two outer panes or, if present, on one of the sides of an inner pane, generally at a height that is situated above the plane(s) that are formed by the glazing interior surface(s) of the spacer(s) incorporated in the insulating glazing. The element to be concealed, in particular the bus bar, is preferably situated in a glazing interior formed by two panes and a glazing interior surface of the spacer.

The spacer according to the invention incorporated in the insulating glazing has been described in detail above. All variants described are conceivable. At least one screen panel can, for example, preferably be arranged on the edge region or at the edge toward the pane contact surface or the inner lateral surface that is in contact with the pane on which the element to be concealed, in particular the bus bar, is attached. However, alternatively, or additionally, it is possible for at least one screen panel to be arranged on the edge region or at the edge toward the pane contact surface or the inner lateral surface that is not in contact with the pane on which the element to be concealed is attached.

In a preferred embodiment of the insulating glazing according to the invention (with main body A or main body B), the at least one screen panel is, consequently, arranged on the edge region or at the edge toward a lateral surface of the spacer that is in contact with the pane on which the element to be concealed, in particular a bus bar, is attached. In this case, the element to be concealed, in particular the bus bar, is arranged between the screen panel and the pane on which the element to be concealed is attached, it being preferred that the element to be concealed, in particular the bus bar, and the screen panel are spaced apart from one another.

Such spacing results in the fact that the element to be concealed, in particular the bus bar, and the screen panel are not in direct contact with one another. This can be advantageous for avoiding contamination, chemical reactions, and/or mechanical effects, in particular if pane on which a bus bar is attached is provided with an electrochromic coating.

In a preferred embodiment of the insulating glazing according to the invention (with main body A or main body B), the at least one screen panel is, consequently, arranged in the edge region or at the edge toward a lateral surface of the spacer that is in contact with the pane on which the element to be concealed, in particular a bus bar, is attached, with the element to be concealed, in particular the bus bar, and the screen panel spaced apart from one another. Thus, a gap is formed between the element to be concealed, in particular the bus bar, and the screen panel, with the gap width preferably being in the range from 1.4 mm to 3 mm.

The screen panel and the pane closest to it are generally spaced apart from one another. The gap thus formed between the screen panel and this pane can, for example, have a gap width of more than 1.4 mm to 3.1 mm.

If the element to be concealed in a triple-pane insulating glass or a quadruple-pane insulating glass is attached to the inner pane, it can also be preferable for two screen panels each to be arranged on the edge region or at the edge toward the two pane contact surfaces or inner lateral surfaces that are in contact with the inner pane.

In an advantageous embodiment of the insulating glazing according to the invention, the panes can be made, independently of one another, of flat glass, float glass, soda lime glass, quartz glass, or borosilicate glass. The thickness of each pane can vary and thus be adapted to the requirements of the individual case. Preferably, panes with standard thicknesses from 1 mm to 19 mm and preferably from 2 mm to 8 mm are used. The panes can be colorless or colored. At least one pane can be implemented as textured glass.

The panes of the insulating glazing are, in particular, insulating glass panes, composite panes, or single glass panes. A composite pane can include at least two panes that are joined to one another via an intermediate layer. The intermediate layer can preferably be a thermoplastic material such as polyvinyl butyral (PVB), ethylene vinyl acetate (EVA), polyurethane (PU), polyethylene terephthalate (PET), or multiple layers thereof, preferably with thicknesses of 0.3 mm to 0.9 mm.

The insulating glazing preferably comprises at least one pane that is a float glass pane, a composite pane, textured glass, or a colored or satin glass. More preferably, at least one pane is a float glass pane.

In a preferred embodiment, at least one pane of the insulating glazing has, at least partially, an electrically conductive and/or electrically switchable coating or an electrically switchable and/or electrically conductive functional element. The electrically conductive and/or electrically switchable coating or the electrically switchable and/or electrically conductive functional element is usually provided on an inner side of one of the two outer panes or, if present, on one of the sides of an inner pane. Such a coating or such a functional element can, for example, function as lighting, heating, or antenna or be used in an electrically switchable glazing such as displays or electrochromic glazing. Such a coating or such a functional element can, for example, also be suitable for alarm glass for a burglar alarm or glass for protection against electromagnetic radiation.

The electrically switchable and/or electrically conductive coating or the electrically switchable and/or electrically conductive functional element is preferably an electrochromic coating, a transparent, electrically conductive coating, or one or a plurality of photovoltaic elements such as solar cells for electric power generation, wherein an electrochromic coating is particularly preferred.

The electrochromic coating preferably includes at least two electrode layers and two electrochemically active layers situated between the two electrode layers, which are separated from one another by an electrolyte layer. The two active layers are in each case capable of reversibly storing small ions, with at least one of the two layers made of an electrochromic material that has different oxidation states that correspond to the stored or released state of the ions and have a different coloration. Through application of electrical voltages of different polarity, the storing or releasing of the ions can be controlled in order to selectively influence the optical transmittance of the coating.

The transparent, electrically conductive coating can be permeable to electromagnetic radiation, preferably electromagnetic radiation of a wavelength from 300 to 1300 nm, in particular for visible light from 390 nm to 780 nm. "Permeable" means that the total transmittance of the pane is, in particular for visible light, preferably >70% and in particular >75%.

The transparent, electrically conductive coating is preferably a functional coating, more preferably a functional coating with solar protection. A coating with solar protection has reflecting properties in the infrared range. The transparent, electrically conductive coating can have particularly low emissivities (low-E). As a result, heating of the interior of a building due to sunlight is advantageously reduced.

Such coatings typically include at least one metal, in particular silver or a silver-containing alloy. The transparent, electrically conductive coating can include a sequence of multiple individual layers, in particular at least one metallic layer and dielectric layers that contain, for example, at least one metal oxide. The metal oxide preferably contains zinc oxide, tin oxide, indium oxide, titanium oxide, silicon oxide, aluminum oxide, or the like, as well as combinations of one or more thereof. The dielectric material can also contain silicon nitride, silicon carbide, or aluminum nitride. This layer structure is generally obtained by a sequence of deposition operations that is carried out by a vacuum method such as magnetic field enhanced cathodic sputtering.

Particularly suitable transparent, electrically conductive coatings contain at least one metal, preferably silver, nickel, chromium, niobium, tin, titanium, copper, palladium, zinc, gold, cadmium, aluminum, silicon, tungsten, or alloys thereof, and/or at least one metal oxide layer, preferably tin-doped indium oxide (ITO), aluminum-doped zinc oxide (AZO), fluorine-doped tin oxide (FTO, $SnO_2$:F), antimony-doped tin oxide (ATO, $SnO_2$:Sb), and/or carbon nanotubes and/or optically transparent, electrically conductive polymers, preferably poly(3,4-ethylene dioxythiophenes), polystyrene sulfonate, poly(4,4-dioctyl-cylopentadithiophene), 2,3-dichloro-5,6-dicyano-1,4-benzoquinone, mixtures, and/or copolymers thereof.

The transparent, electrically conductive coating preferably has a layer thickness of 10 nm to 5 μm and particularly preferably of 30 nm to 1 μm. The sheet resistance of the transparent, electrically conductive coating is, for example, 0.35 ohm/square to 200 ohm/square, preferably 0.6 ohm/square to 30 ohm/square, and in particular 2 ohm/square to 20 ohm/square.

For contacting the electrically switchable and/or electrically conductive coating, in particular the electrochromic coating, or the electrically switchable and/or electrically conductive functional element, at least two bus bars that are electrically connected to the coating or to the functional element are, in particular, provided.

The bus bar is an element to be concealed, as described above. The bus bar is, for example, strip-shaped or wire-shaped. The bus bar is preferably arranged on a pane in a glazing interior that is formed by two panes and a glazing interior surface of the spacer. The bus bar runs, in particular, parallel to the glazing interior surface of the spacer.

The bus bar is made of an electrically conductive material, such as silver, copper, copper alloy, or aluminum. It can be produced, for example, by printing a conductive silver paste on the electrically conductive and/or electrically switchable coating for electrical contacting. The conductive silver paste contains silver particles and, optionally, glass frits. The layer thickness of the baked conductive paste is, for example, approx. 5 μm to 20 μm. The bus bar can also be formed from metal foil strips or metal wires that contain or are made of copper, a copper alloy, or aluminum. The metal foil strips or metal wires can be applied to the electrically conductive and/or electrically switchable coating by means of an electrically conductive adhesive.

Furthermore, the insulating glazing preferably has one or a plurality, preferably at least one or two, electrical connection elements for connecting to a power supply and one or a plurality, preferably at least one or two, electrical contact elements for the electrical connection of the bus bars to the electrical connection elements.

The connection elements can, for example, be a cable and/or a flexible printed circuit board with at least one electrical component. The cable can, for example, be a flat cable or a round cable. The cable can have one or a plurality of conductors. Flexible printed circuit boards usually have a flexible plastic carrier that is printed with an electronic circuit.

The electrical contact element for the electrical connection of the bus bars to the electrical connection element is, e.g., a spring contact, or contacting is preferably done by soldering; adhesive contacts are also conceivable.

In the following, a variant of a double-pane insulating glass and two variants of a triple-pane insulating glass are described for the insulating glazing according to the invention. With regard to individual components of these embodiments of the insulating glazing mentioned there, reference is also made to the above information, which also applies to them.

In a preferred embodiment, the insulating glazing comprises:

- a first pane and a second pane, wherein an interior-side surface of the first pane or the second pane has, at least partially, an electrically switchable and/or electrically conductive coating or an electrically switchable and/or electrically conductive functional element, as well as at least two bus bars for contacting the coating or the functional element,
- a spacer surrounding the first and second pane, which is a spacer with the main body A according to the invention, wherein the first pane is connected to the first pane contact surface of the spacer directly or via a sealant and the second pane is connected to the second pane contact surface of the spacer directly or via a sealant,
- a glazing interior formed between the glazing interior surface of the spacer and the first and the second pane,
- an outer interpane space adjacent the outer surface, in which an outer seal is inserted, and
- one or a plurality of electrical connection elements for connecting to a power supply and one or a plurality of electrical contact elements for the electrical connection of the bus bars to the electrical connection elements, wherein at least one bus bar is situated in the glazing interior and when viewed from the outside, at least from certain viewing angles, the at least one screen panel of the spacer obscures the view of the bus bar.

In another preferred embodiment, the insulating glazing comprises:

a first pane, a second pane, and a third pane, wherein the third pane (inner pane) is arranged between the first and second pane and parallel thereto, wherein an interior-side surface of the first pane or the second pane or a surface of the third pane has, at least partially, an electrically switchable and/or electrically conductive coating or an electrically switchable and/or electrically conductive functional element as well as at least two bus bars for contacting the coating or the functional element, a first spacer, which is a spacer with the main body A according to the invention, and a second spacer, wherein the second spacer is likewise a spacer with the main body A according to the invention or is a conventional spacer, which has a first pane contact surface, a second pane contact surface extending parallel thereto, a glazing interior surface, and an outer surface, wherein the first spacer surrounds the first and third pane, wherein the first pane is connected to the first pane contact surface of the first spacer directly or via a sealant, and the third pane is connected to the second pane contact surface of the first spacer directly or via a sealant, and the second spacer surrounds the second and third pane, wherein the second pane is connected to the second pane contact surface of the second spacer directly or via a sealant, and the third pane is connected to the first pane contact surface of the second spacer directly or via a sealant, a first glazing interior formed between the first and the third pane and the glazing interior surface of the first spacer with the main body A, and a second glazing interior formed between the second and the third pane and the glazing interior surface of the second spacer, a first outer interpane space adjacent the outer surface of the first spacer with the main body A, in which an outer seal is inserted, and a second outer interpane space adjacent the outer surface of the second spacer, in which an outer seal is inserted, and one or a plurality of electrical connection elements for connecting to a power supply and one or a plurality of electrical contact elements for the electrical connection of the bus bars to the electrical connection elements, wherein at least one bus bar is situated in the first or second glazing interior, and when viewed from the outside, at least from certain viewing angles, the at least one screen panel of the first spacer obscures the view of the bus bar.

In another preferred embodiment, the insulating glazing comprises:

a first pane, a second pane, and a third pane, wherein the third pane (inner pane) is arranged between the first and second pane and parallel thereto, wherein an interior-side surface of the first pane or the second pane or a surface of the third pane has, at least partially, an electrically switchable and/or electrically conductive coating or an electrically switchable and/or electrically conductive functional element as well as at least two bus bars for contacting the coating or the functional element, a spacer surrounding the first and second pane, which is a spacer with the main body B according to the invention, wherein the first pane is connected to the first pane contact surface of the spacer directly or via a sealant, and the second pane is connected to the second pane contact surface of the spacer directly or via a sealant, and the third pane is received in the groove of the spacer, a first glazing interior formed between the first and the third pane and the first glazing interior surface of the spacer, and a second glazing interior formed between the second and the third pane and the second glazing interior surface of the spacer, an outer interpane space adjacent the outer surface of the spacer, in which an outer seal is inserted, and one or a plurality of electrical connection elements for connecting to a power supply and one or a plurality of electrical contact elements for the electrical connection of the bus bars to the electrical connection elements, wherein at least one bus bar is situated in the first or second glazing interior, and when viewed from the outside, at least from certain viewing angles, the at least one screen panel of the spacer obscures the view of the bus bar.

If used, the sealant for connecting the lateral contact surface of the spacer and the pane serves, on the one hand, for bonding the spacer and, on the other, for sealing the gap between the spacer and the pane. Suitable sealants are based, for example, on butyl rubber, polyisobutylene, polyethylene vinyl alcohol, ethylene vinyl acetate, polyolefin rubber, copolymers and/or mixtures thereof. In the case of the spacers described above that are extruded directly onto the pane (TPS spacers), no separate sealing material is required, since this function is already fulfilled by the spacer itself.

The one or a plurality of, preferably at least two, electrical connection elements of the insulating glazing are expediently positioned below the outer surface of the spacer. The one or a plurality of, preferably at least two, electrical connection elements of the insulating glazing are preferably guided outward from the sealed outer interpane space.

The outer seal can be directly adjacent the outer surface of the main body or can be connected thereto via a sealant. Suitable interposed sealants are, for example, the sealants described above. The outer seal usually fills the outer interpane space or the first and second outer interpane space in its entire width between the panes.

The outer seal preferably contains a polymer or a silane-modified polymer, particularly preferably organic polysulfides, silicones, silicone rubber that can be room-temperature vulcanized, high temperature vulcanized, peroxide vulcanized, or addition vulcanized, polyurethanes, and/or butyl rubber. Such materials have very good adhesion to glass such that the outer seal serves above all for bonding of the panes and contributes to the mechanical stability of the insulating glazing. In an optional embodiment, additives to increase aging resistance, for example, UV stabilizers, can also be included.

The glazing interior formed between the panes and the spacer(s) can be filled with air or another gas, in particular a noble gas, such as, argon or krypton.

The insulating glazing according to the invention is suitable in particular as building interior glazing, building exterior glazing, or façade glazing.

In the following, the invention is explained in detail with reference to drawings and exemplary embodiments. The drawings are schematic representations and not to scale. The drawings in no way restrict the invention.

Figure 2:
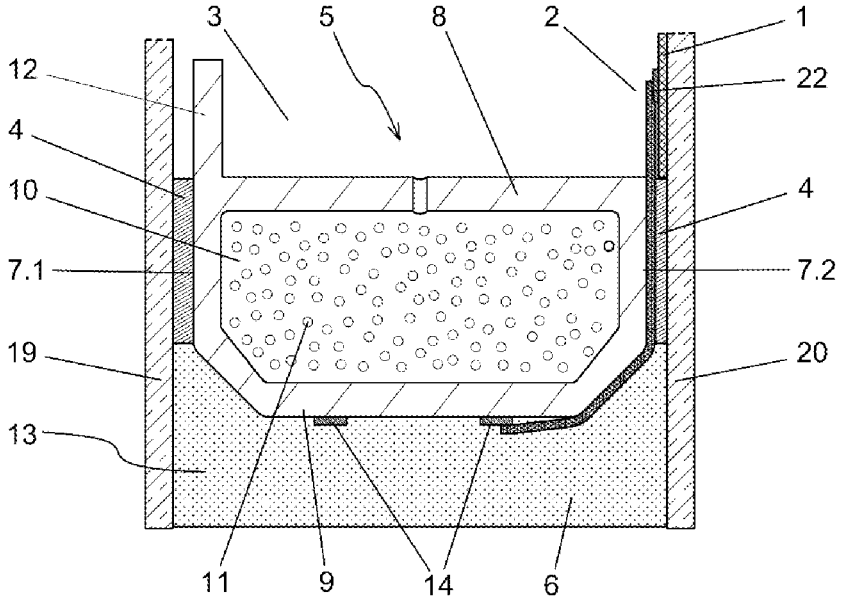
Figure 3A:
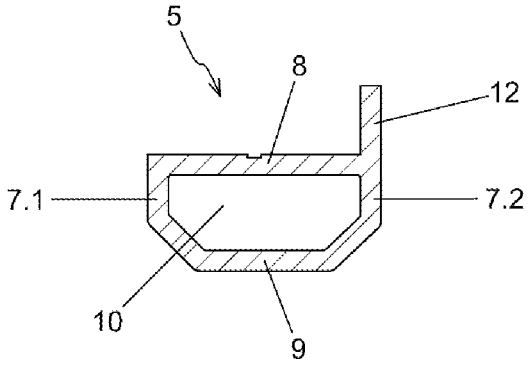
Figure 3B:
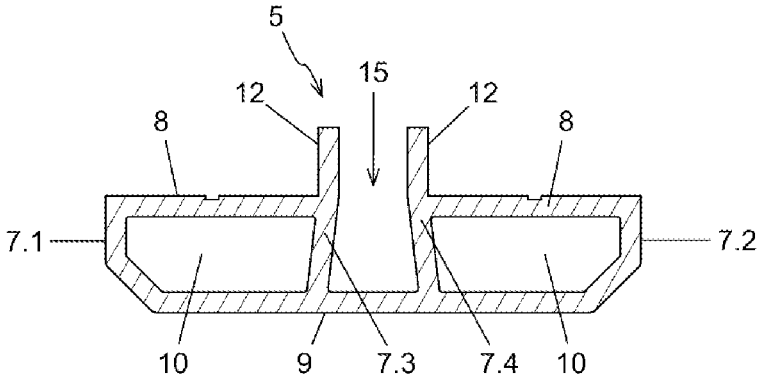
Figure 4:
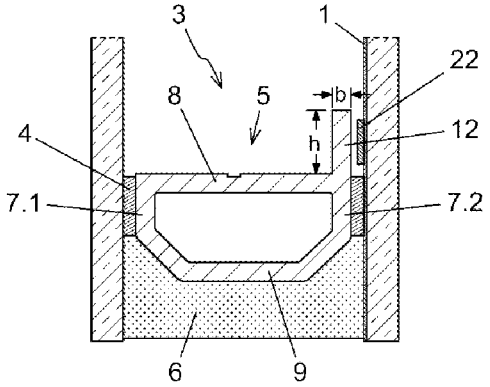
Figure 5:
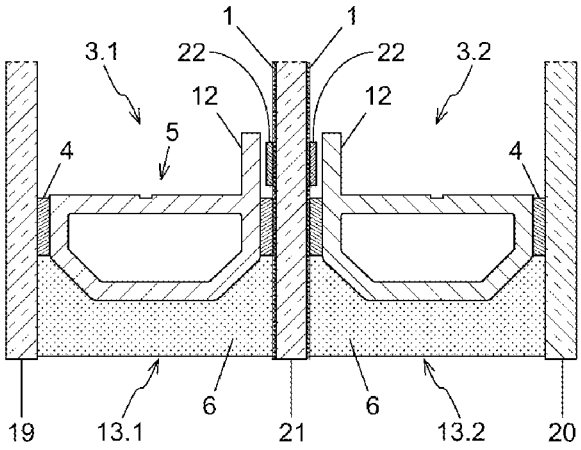
Figure 6:
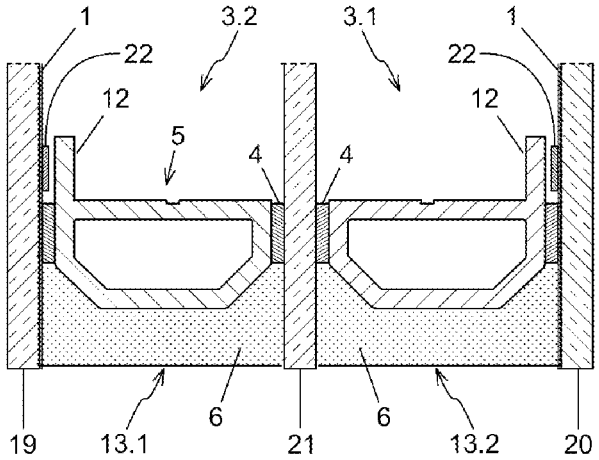
Figure 7A:
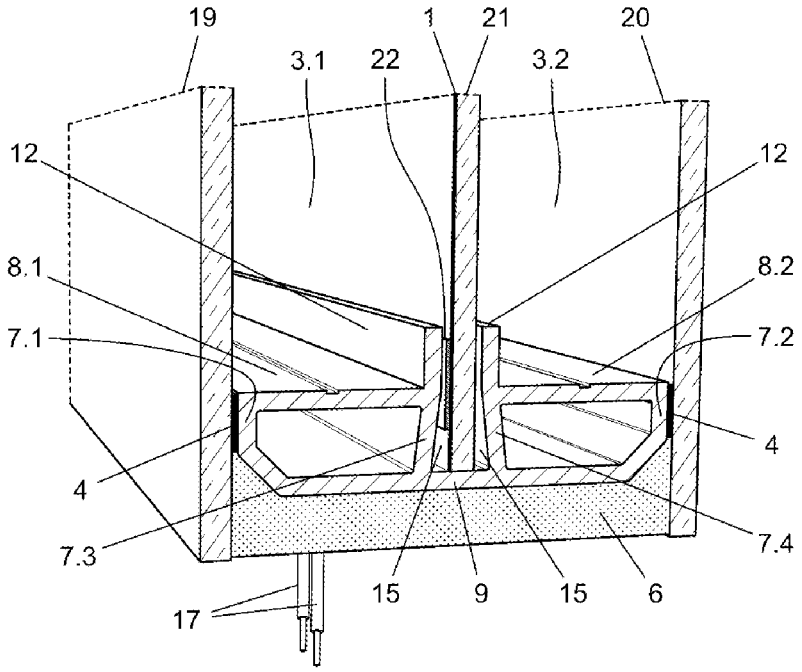
Figure 7B:
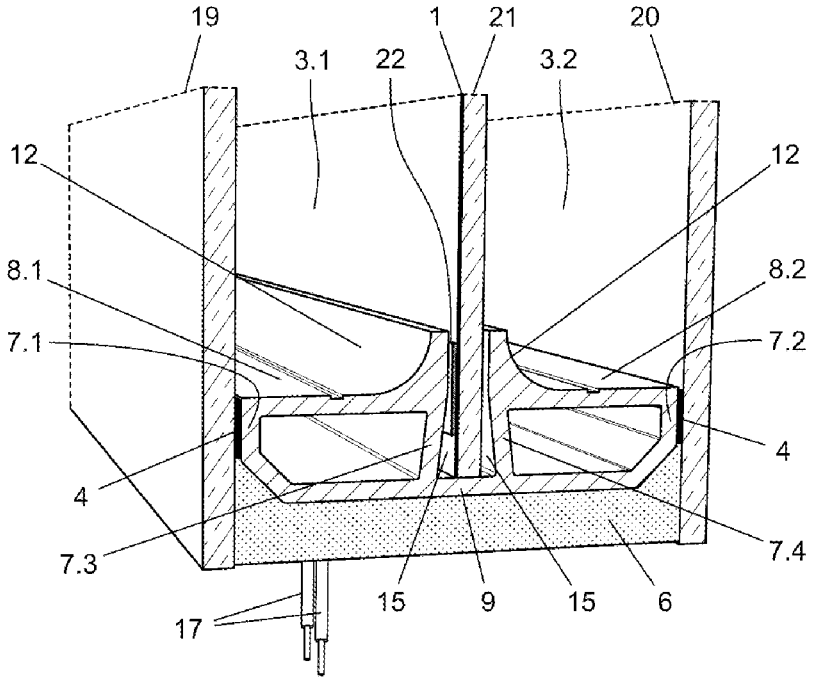
Figure 8A:
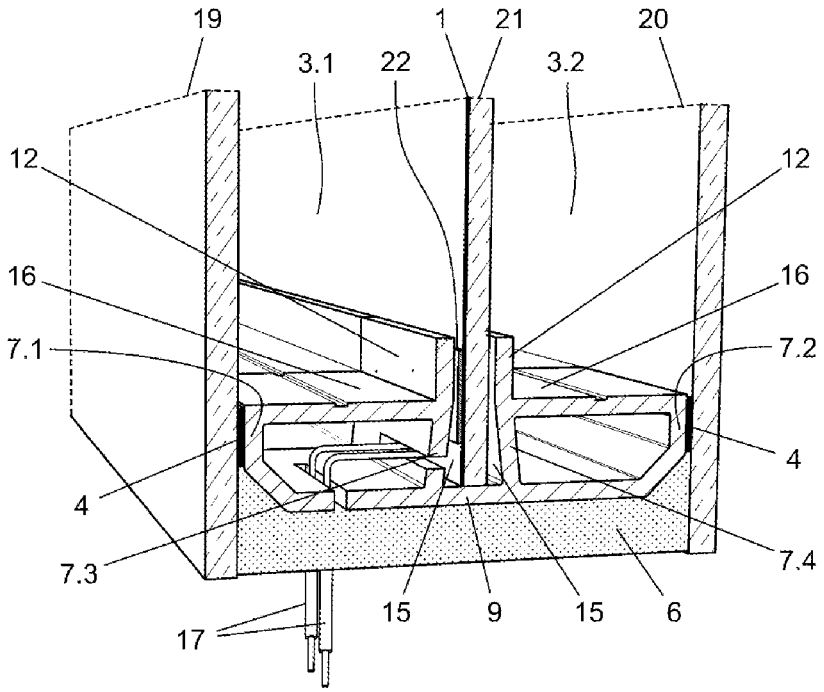
Figure 8B:
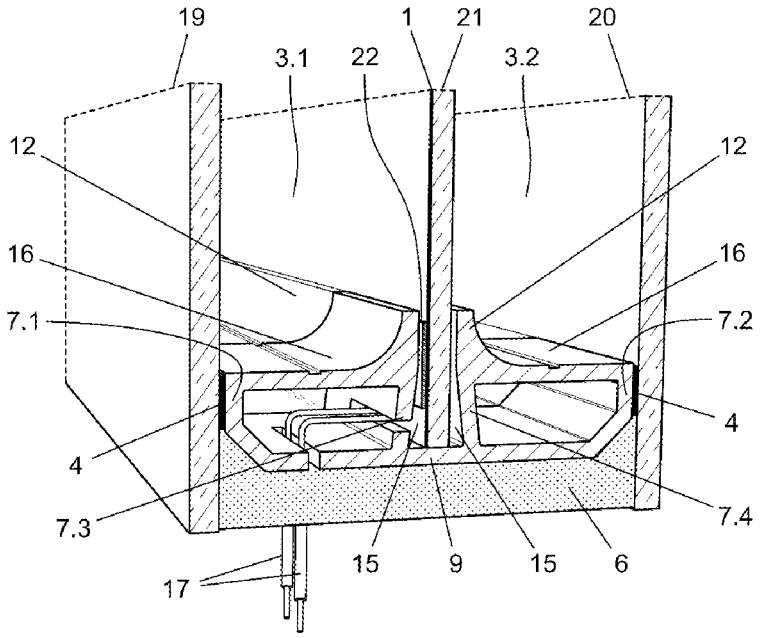

They depict:

FIG. 1 a cross-sectional representation of an insulating glazing with an electrically conductive and/or electrically switchable coating on one side of the pane, FIG. 2 a cross-sectional representation of an insulating glazing according to the invention with an electrically conductive and/or electrically switchable coating on one side of the pane, FIG. 3*a* a cross-sectional representation of a spacer according to the invention, FIG. 3*b* a cross-sectional representation of another spacer according to the invention, FIG. 4 a cross-sectional representation of another insulating glazing according to the invention, FIG. 5 a cross-sectional representation of another insulating glazing according to the invention, FIG. 6 a cross-sectional representation of another insulating glazing according to the invention, FIG. 7*a* a perspective view of another insulating glazing according to the invention, FIG. 7*b* a perspective view of another insulating glazing according to the invention, FIG. 8*a* a perspective view of another insulating glazing according to the invention, FIG. 8*b* a perspective view of another insulating glazing according to the invention.

FIG. 1 depicts a representation of an insulating glazing in cross-section. The insulating glazing comprises a first pane 19 and a second pane 20, which are connected via a spacer 5. The spacer 5 is mounted between the first pane 19 and the second pane 20 arranged parallel thereto. The spacer 5 has a main body, which has a first pane contact surface 7.1, a second pane contact surface 7.2 that extends parallel to the first pane contact surface, an outer surface 9, and a glazing interior surface 8. The outer surface 9 is connected to the two pane contact surfaces 7.1, 7.2 in each case via a connecting surface. The main body has a hollow space 10 that contains a desiccant 11. A glazing interior 3 is defined by the first pane 19, the second pane 20, and the glazing interior surface 8 of the main body. The first pane 19 is connected to the first pane contact surface 7.1 via a sealant 4, and the second pane 20 is connected to the second pane contact surface 7.2 via a sealant. An outer interpane space 13 is delimited by the first pane 19, the second pane 20, and the outer surface 9 of the main body and is filled with an outer seal 6.

The second pane 20 has an electrically conductive and/or electrically switchable coating 1 on the interior-side surface. The coating 1 extends almost completely over the interior-side surface of the pane, minus an edge decoating of the pane edge. The coating 1 is contacted by a bus bar 22. The insulating glazing has electrical connection elements 14, e.g., ribbon cables or cables, which are arranged below the outer surface 9 of the spacer and can be connected to a voltage source (not shown). Connection element 14 and bus bar 22 are electrically conductively connected to one another via an electrical contact element 2. The electrical contact between the electrically conductive and/or electrically switchable coating 1 and bus bar 22 as well as between bus bar 22 and the contact element 2 can be established by soldering or gluing with an electrically conductive adhesive. The contact element 2 can consist of a flexible cable. The cable can be T-shaped and have two metallic contact surfaces on its two side arms, which are provided for contacting with the bus bar 22.

The bus bar 22 was produced by printing a conductive paste and electrically contacted on the electrically conductive coating 1. The conductive paste, also referred to as silver paste, contains silver particles and glass frits. The layer thickness of the baked conductive paste is, for example, roughly 5 μm to 20 μm. Alternatively, thin and narrow metal foil strips or metal wires containing or made of copper, a copper alloy, or aluminum can also be used as bus bars 22. The bus bar 22 runs on the second pane in the glazing interior 3 and parallel to the glazing interior surface 8 of the main body.

The first pane is provided on its outside with an opaque coating 23 which is a black coating. The coating is applied in the form of a strip and is situated roughly in a region at the height between the glazing interior surface 8 and the upper and of the bus bar 22. The opaque coating 23 can be approx. 15 to 30 mm wide (from the glass edge). The coating 23 restricts the through-vision region of the insulating glazing and completely obscures the bus bar 22 when viewed from the outside within a certain viewing angle range.

FIG. 2 depicts a representation of an insulating glazing according to the invention in cross-section. The insulating glazing corresponds to the insulating glazing depicted in FIG. 1, except that the spacer depicted in FIG. 1 is replaced by a spacer according to the invention, and the opaque coating 23 depicted in FIG. 1 is not present. Apart from these differences, the information for FIG. 1, to which reference is made, also applies to FIG. 2.

The spacer 5 has a main body, which comprises a first pane contact surface 7.1, a second pane contact surface 7.2 that extends parallel to the first pane contact surface, an outer surface 9, and a glazing interior surface 8. The main body has a hollow space 10, which contains a desiccant 11. The spacer 5 further has a screen panel 12 on the glazing interior surface 8, which is arranged at the edge toward the first pane contact surface 7.1.

The electrically conductive and/or electrically switchable coating 1 is an electrochromic coating.

The main body is formed in one piece with the screen panel 12 and can be produced in one step by extrusion. The main body and the screen panel are made of the same material, which is opaque and can be any color, preferably black, gray, white, or brown. The main body has, for example, a height of approx. 6 mm and a width of approx. 15 mm. The dimensioning must, of course, be adapted to the respective requirements; for example, the width must be adapted to the requirements of good thermal insulation. The screen panel is rectangular and has a height of approx. 10 mm. The width of the screen panel is approx. 1 mm.

The first pane 19 can be a float glass, optionally as single-plane safety glass ESG, partially tempered safety glass TVG, or laminated safety glass VSG. The thickness is approx. 4 mm. The second pane 20 is a float glass and has a thickness of approx. 4 mm.

The main body and the screen panel are made of styrene acrylonitrile (SAN), which is opaque and has any color, preferably black, gray, white, or brown. The distance from the plane of the glazing interior surface 8 to the upper end of the bus bar 22 is approx. 9 mm. Butyl was used as the sealant 4, and silicone was used as the outer sealant 6.

When viewed from the outside within a certain viewing angle, the bus bar 22 is completely obscured by the screen panel 12 of the spacer. The spacer according to the invention saves a production step since it is no longer required to apply an opaque coating to one of the panes, which is necessary according to FIG. 1. Another advantage consists in that the main body and the screen panel are the same color, whereas, as depicted in FIG. 1, the opaque coating 23 and the spacer usually have different colors for production engineering reasons, thus improving the aesthetic appearance of the insulating glazing according to the invention.

Eliminating the outer covering (screen print) results in uniform appearance of the entire pane since the reflection behavior of the pane is identical over the entire surface.

FIG. 3*a* depicts a representation of a spacer according to the invention in cross-section that was used in the insulating glazing of FIG. 4. Reference is made to the information there about the spacer.

FIG. 3*b* depicts a representation of a spacer according to the invention in cross-section, which is suitable for a triple glazing. The spacer comprises a main body (main body B), which has a first pane contact surface 7.1 and a second pane contact surface 7.2 extending parallel thereto, a first glazing interior surface 8.1, a second glazing interior surface 8.2, a first inner lateral surface 7.3, a second inner lateral surface 7.4, and an outer surface 9. The two inner lateral surfaces run between the two pane contact surfaces and parallel thereto and form, together with the two glazing interior surfaces and the outer surface, a groove 15 for receiving a pane. A screen panel 12 is arranged on the first inner lateral surface 7.3 at the edge toward the first inner lateral surface 7.3. A second screen panel 12 is arranged on the second inner lateral surface 7.4 at the edge toward the second inner lateral surface 7.4.

The main body is formed in one piece with the two screen panels 12 and can be produced in one step by extrusion. The main body and the screen panel are made of the same material, such as SAN, which is opaque and is any color, preferably black, gray, white, or brown.

FIG. 4 depicts a representation of another insulating glazing according to the invention in cross-section. The insulating glazing basically corresponds to the insulating glazing depicted in FIG. 2, except that in the spacer according to the invention depicted in FIG. 4, the spacer 5 has a screen panel 12 on the glazing interior surface 8, which is arranged at the edge toward the second pane contact surface 7.2. In this manner, the screen panel 12 is situated in the immediate vicinity of the bus bar 22 attached to the second pane 20.

For reasons of clarity, electrical connection elements and contact elements are not shown.

The spacer corresponds to the spacer depicted in FIGS. 2 and 3*a*, except that in the arrangement according to FIG. 4, it has been positioned reversed compared to FIG. 2. The information concerning the spacer in FIG. 2 or 3*a* applies mutatis mutandis.

The advantages mentioned in relation to FIG. 2 with regard to saving a production step and improved aesthetic appearance of the insulating glazing according to the invention also result from this variant. In addition, further improved concealment of the bus bar is can be noted: it is not visible from the outside even when viewed at a very oblique viewing angle.

FIG. 5 depicts a representation of another insulating glazing according to the invention in cross-section, which is a triple insulating glazing. Here, two spacers per FIG. 2 or 3*a* are used. The information concerning the spacer in FIG. 2 or 3*a* applies mutatis mutandis.

The insulating glazing comprises a first pane 19, a second pane 20, and a third pane 21, wherein the third pane 21 (inner pane) is arranged between the first and second pane and parallel thereto. Both sides of the third pane are in each case partially provided with an electrically switchable and/or electrically conductive coating 1, such as an electrochromic coating, which is in each case contacted by a bus bar 22 that was produced by screen printing with a silver paste and baking.

A first spacer 5 with the main body A is arranged circumferentially between the first and third pane. A second spacer with the main body A is arranged circumferentially between the second and third pane. The first pane contact surface of the first spacer is connected to the first pane via a sealant 4. The second pane contact surface of the first spacer is connected to the third pane via a sealant 4. The first pane contact surface of the second spacer is connected to the third pane via a sealant 4. The second pane contact surface of the second spacer is connected to the second pane via a sealant 4. A first glazing interior 3.1 is formed between the first and the third pane 19, 21 and the glazing interior surface 8 of the first spacer, and a second glazing interior 3.2 is formed between the second and the third pane 20, 21 and the glazing interior surface of the second spacer. Furthermore, there is a first outer interpane space 13.1 adjacent the outer surface of the first spacer, in which an outer seal 6 is inserted, and a second outer interpane space 13.2 adjacent the outer surface of the second spacer, in which an outer seal 6 is inserted. For reasons of clarity, electrical connection elements and contact elements are not shown.

The first spacer has a screen panel 12 on the glazing interior surface at the edge toward the second pane contact surface such that the screen panel 12 is situated in the immediate vicinity of the bus bar 22 that is arranged at the side of the third pane 21 that is opposite the first pane. The second spacer has a screen panel 12 on the glazing interior surface at the edge toward the first pane contact surface such that this screen panel 12 is situated in the immediate vicinity of the bus bar 22 that is arranged at the side of the third pane 21 that is opposite the second pane.

The advantages mentioned for FIG. 4 are also noted here. The variant of the spacer depicted in FIG. 5 is, for aesthetic reasons, also useful for an analogous embodiment in which, instead of both sides, only one side of the third pane is partially provided with an electrically switchable and/or electrically conductive coating 1, such as an electrochromic coating that is contacted in each case by a bus bar 22.

FIG. 6 depicts a representation of another insulating glazing according to the invention in cross-section, which depicts a triple insulating glass. The structure essentially corresponds to the structure of FIG. 5; however, here, the two electrically switchable and/or electrically conductive coatings 1 and the bus bars 22 associated therewith are arranged on the inner side of the first pane 19 and on the inner side of the second pane 20.

Also, here, the first spacer has a screen panel 12 on the glazing interior surface at the edge toward to the first pane contact surface such that the screen panel 12 is situated in the immediate vicinity of the bus bar 22 that is arranged on the first pane 19. Furthermore, the second spacer has a screen panel 12 on the glazing interior surface at the edge toward the second pane contact surface such that this screen panel 12 is situated in the immediate vicinity of the bus bar 22 that is arranged on the second pane 20.

The advantages mentioned for FIG. 4 are also noted here. Optionally, it can additionally be useful to maintain an outer opaque coating as depicted in FIG. 1 as 23 by means of screen printing on the first pane 19, in order to prevent viewing the bus bar from the outside. The same applies to the interior-side face of the pane 20. As long as the electrochromic coating is applied to the middle pane 21, as shown in FIG. 5, the screen print can be applied either on the inner or the outer sides of the panes 19 or 20.

FIG. 7*a* depicts a perspective view of another insulating glazing according to the invention in cross-section, which depicts a triple insulating glass. In this structure, a spacer with a main body B is incorporated, which corresponds to the spacer depicted in FIG. 3*b*. The information provided there applies mutatis mutandis.

The insulating glazing comprises a first pane 19, a second pane 20, and a third pane 21, wherein the third pane 21 (inner pane) is arranged between the first and second pane 19, 20 and parallel thereto. The side of the third pane 21 opposite the first pane is partially provided with an electrically switchable and/or electrically conductive coating 1, such as an electrochromic coating, which is contacted by a bus bar 22.

The first pane contact surface 7.1 of the spacer is connected to the first pane 19 via a sealant 4. The second pane contact surface 7.2 of the spacer is connected to the second pane 20 via a sealant 4. The third pane 21 is received in the groove 15 of the spacer. This arrangement forms a first glazing interior 3.1 between the first and third pane and a second glazing interior 3.2 between the first and third pane. Moreover, there is an outer interpane space 13 adjacent the outer surface 9 of the spacer, in which an outer seal is inserted. For reasons of clarity, electrical connection elements and contact elements are not shown; only the electrical connections 17 leading out of the insulating glass are indicated schematically.

The screen panel 12 on the first glazing interior surface 8.1 at the edge toward the first inner lateral surface 7.3 of the spacer and the screen panel 12 on the second glazing interior surface 8.2 at the edge toward the second inner lateral surface 7.4 of the spacer are situated in the vicinity of the bus bar 22 and can largely obscure it.

FIG. 7*b* depicts a perspective view of another insulating glazing according to the invention in cross-section, which depicts a triple insulating glass. This structure is a variant of the structure per FIG. 7*a*. The only difference consists in that the screen panels do not have a rectangular shape, but, instead, a shape tapering from the bottom to the top. The side of the screen panel that is flush with the first or second inner lateral surface 7.3, 7.4, is planar, whereas the opposite side tapers conically upward. This has advantages in terms of the stability and the production of the spacer in one piece. Furthermore, this can result in even more attractive optics.

FIG. 8*a* depicts a perspective view of another insulating glazing according to the invention in cross-section, which depicts a triple insulating glass. This structure is a variant of the structure per FIG. 7*a*. The difference consists in that, here, the spacer is designed in two parts relative to the longitudinal direction. A separate spacer end piece 16 is provided for feeding the cabling and is also provided with openings to enable easier routing of the cabling.

FIG. 8*b* depicts a perspective view of another insulating glazing according to the invention in cross-section, which depicts a triple insulating glass. This structure is a variant of the structure per FIG. 7*b*. The difference consists in that, here, the spacer is designed in two parts relative to the longitudinal direction. A separate spacer end piece 16 is provided for feeding the cabling and is also provided with openings to enable easier routing of the cabling.

LIST OF REFERENCE CHARACTERS

1 electrically conductive and/or electrically switchable coating
2 electrical contact element
3 glazing interior
3.1 first glazing interior
3.2 second glazing interior
4 sealant
5 spacer
6 outer seal
7.1 first pane contact surface
7.2 second pane contact surface
7.3 first inner lateral surface
7.4 second inner lateral surface
8 glazing interior surface
8.1 first glazing interior surface
8.2 second glazing interior surface
9 outer surface
10 hollow space
11 desiccant
12 screen panel
13 outer interpane space
13.1 first outer interpane space
13.2 second outer interpane space
14 cable or ribbon cable
15 groove
16 spacer end piece
17 electrical connection lines
19 first pane
20 second pane
21 third pane
22 bus bar
23 opaque coating
h height of screen panel
b width of screen panel,

The invention claimed is:

1. An insulating glazing, comprising:

at least two panes;

at least one spacer comprising a main body, wherein the main body is a main body A comprising a first pane contact surface, a second pane contact surface extending parallel thereto, a glazing interior surface, and an outer surface, or wherein the main body is a main body B comprising a first pane contact surface and a second pane contact surface extending parallel thereto, a first glazing interior surface, a second glazing interior surface, a first inner lateral surface, a second inner lateral surface, and an outer surface, wherein the first and second inner lateral surfaces extend between the first and second pane contact surfaces and parallel thereto and, together with the first and second glazing interior surfaces and the outer surface, form a groove for receiving a pane, wherein the spacer has a single flange forming a single screen panel made of an opaque material arranged on the glazing interior surface of the main body A or at least one flange forming at least one screen panel arranged on at least one of the first and second glazing interior surfaces of the main body B and extending parallel to the first and second pane contact surfaces, and a concealed element that is a bus bar, a connection line or an electrical connection element, wherein the at least two panes form, together with the spacer, at least one glazing interior, wherein the concealed element is arranged on an interior-side pane surface such that the concealed element is located between the screen panel and the interior-side pane surface so that the screen panel of the spacer obscures the concealed element when viewed from the outside, at least from certain viewing angles, wherein the single screen panel of the main body A or the at least one screen panel of the main body B is arranged at an edge at a lateral surface of the spacer, which is in contact with the pane on which the concealed element is attached, and has a screen panel surface that faces the concealed element, said screen panel surface being arranged such that the screen panel surface is flush with said lateral surface of the spacer, wherein the lateral surface of the spacer is selected from the first pane contact surface or the second pane contact surface for the spacer with the main body A or is selected from the first pane contact surface, the second pane contact surface, the first inner lateral surface, or the second inner lateral surface for the spacer with the main body B.

2. The spacer insulating glazing according to claim 1, wherein the at least one screen panel has a height h in the range from 2 to 50 mm.

3. The insulating glazing according to claim 2, wherein the height h in the range from 4 to 15 mm.

4. The insulating glazing according to claim 1, wherein the screen panel has, in cross-section, a rectangular basic shape, or the screen panel tapers, in cross-section, at least partially from bottom to top.

5. The spacer insulating glazing according to claim 1, wherein the main body is formed in one piece with the screen panel, or the main body and the screen panel form separate parts that are connected to one another.

6. The spacer insulating glazing according to claim 1, wherein the main body is made of metal or plastic, and/or the main body and the screen panel are made of the same material.

7. The insulating glazing according to claim 1, comprising a first pane and a second pane, wherein the interior-side pane surface of the first pane or the second pane has, at least partially, an electrically switchable and/or electrically conductive coating or an electrically switchable and/or electrically conductive functional element, as well as at least two bus bars for contacting the coating or the functional element, the spacer with the main body A surrounding the first and second pane, wherein the first pane is connected to the first pane contact surface of the spacer directly or via a sealant, and the second pane is connected to the second pane contact surface of the spacer directly or via a sealant, a glazing interior formed between the glazing interior surface of the spacer and the first and the second pane, an outer interpane space adjacent the outer surface, in which an outer seal is inserted, and one or a plurality of electrical connection elements for connecting to a power supply and one or a plurality of electrical contact elements for the electrical connection of the bus bars to the electrical connection elements, wherein at least one bus bar is situated in the glazing interior and forms the concealed element, and when viewed from the outside, at least from certain viewing angles, the single screen panel of the spacer obscures the view of the bus bar.

8. The insulating glazing according to claim 7, wherein the electrically switchable and/or electrically conductive coating or the electrically switchable and/or electrically conductive functional element is an electrochromic coating, a transparent electrically conductive coating, or one or a plurality of photovoltaic elements.

9. The insulating glazing according to claim 1, comprising a first pane, a second pane, and a third pane, wherein the third pane is arranged between the first and second pane and parallel thereto, wherein the interior-side pane surface of the first pane or the second pane or a surface of the third pane has, at least partially, an electrically switchable and/or electrically conductive coating or an electrically switchable and/or electrically conductive functional element as well as at least two bus bars for contacting the coating or the functional element, the spacer with the main body A as a first spacer and a second spacer, wherein the second spacer is likewise a spacer with the main body A or a spacer that has a first pane contact surface, a second pane contact surface extending parallel thereto, a glazing interior surface, and an outer surface, wherein the spacer with the main body A surrounds the first and third pane, wherein the first pane is connected to the first pane contact surface of the spacer directly or via a sealant, and the third pane is connected to the second pane contact surface of the spacer directly or via a sealant, and the second spacer surrounds the second and third pane, wherein the second pane is connected to the second pane contact surface of the spacer directly or via a sealant, and the third pane is connected to the first pane contact surface of the spacer directly or via a sealant, or the spacer with the main body B surrounding the first and second pane, wherein the first pane is connected to the first pane contact surface of the spacer directly or via a sealant, and the second pane is connected to the second pane contact surface of the spacer directly or via a sealant, and the third pane is received in the groove of the spacer, a first glazing interior formed between the first and the third pane and the glazing interior surface of the first spacer with the main body A, and a second glazing interior formed between the second and the third pane and the glazing interior surface of the second spacer, or a first glazing interior formed between the first and the third pane and the first glazing interior surface of the spacer with the main body B, and a second glazing interior formed between the second and the third pane and the second glazing interior surface of the spacer with the main body B, a first outer interpane space adjacent the outer surface of the first spacer with the main body A, in which an outer seal is inserted, and a second outer interpane space adjacent the outer surface of the second spacer, in which an outer seal is inserted, or an outer interpane space adjacent the outer surface of the spacer with the main body B, in which an outer seal is inserted, and one or a plurality of electrical connection elements for connecting to a power supply and one or a plurality of electrical contact elements for the electrical connection of the bus bars to the electrical connection elements, wherein at least one bus bar is situated in the first or second glazing interior and forms the concealed element, and when viewed from the outside, at least from certain viewing angles, the at least one screen panel of the spacer obscures the view of the bus bar.

10. The insulating glazing according to claim 1, wherein at least one of the first pane, the second pane, and, if present, the third pane is a float glass pane, a composite pane, a textured glass, or a colored or satin glass.

11. The insulating glazing according to claim 1, wherein the concealed element and the screen panel are spaced apart from one another.

12. The insulating glazing according to claim 1, wherein a gap is formed between the concealed element and the screen panel, and the gap has a width from 1.4 mm to 3 mm.

13. The insulating glazing according to claim 1, wherein the concealed element is a bus bar.

14. The insulating glazing according to claim 1, wherein the concealed element is a bus bar or a connection line that has a height that is less than a height of the panel so that the screen panel obscures the bus bar or the connection line when viewed from the outside, at least from certain viewing angles.

15. The insulating glazing according to claim 1, wherein the lateral surface of the spacer is in contact with the pane on which the concealed element is attached via a sealant.

16. A method comprising utilizing an insulating glazing according to claim 1 as building interior glazing, building exterior glazing, and/or facade glazing.

* * * * *